US005560807A

United States Patent [19]

Hauser

[11] Patent Number: 5,560,807

[45] Date of Patent: Oct. 1, 1996

[54] HEADBOX ADDITIVE INJECTION SYSTEM

[75] Inventor: Merle W. Hauser, Beloit, Wis.

[73] Assignee: Beloit Technologies, Inc., Wilmington, Del.

[21] Appl. No.: 412,631

[22] Filed: Mar. 29, 1995

[51] Int. Cl.[6] ..... D21F 11/02

[52] U.S. Cl. ..... 162/183; 162/158; 162/216; 162/336

[58] Field of Search ..... 162/183, 182, 162/158, 175, 176, 177, 336, 338, 343, 344, 216, 212, 215, 185

[56] References Cited

U.S. PATENT DOCUMENTS

| | | | |
|---|---|---|---|
| 4,141,788 | 2/1979 | Justus . | |
| 4,897,158 | 1/1990 | Weisshuhn et al. | 162/259 |
| 4,909,904 | 3/1990 | Kinzler | 162/343 |
| 4,940,512 | 7/1990 | Hendren et al. | 162/109 |
| 5,017,268 | 5/1991 | Clitherow et al. | 162/146 |
| 5,147,509 | 9/1992 | Kuragasaki et al. | 162/343 |
| 5,149,402 | 9/1992 | Riddick | 162/336 |
| 5,196,091 | 3/1993 | Hergert . | |

OTHER PUBLICATIONS

Brochure–"Beloit Concept III 198 Headbox . . . delivers a uniform . . ." Published by Beloit Corporation.

Brochure–"Beloit Technology Update: Concept IV–MH 198 Headbox–The Next Generation Converflo " Published by Beloit Corp.

*Primary Examiner*—Donald E. Czaja
*Assistant Examiner*—Calvin Padgett
*Attorney, Agent, or Firm*—Dirk J. Veneman; Raymond W. Campbell; David J. Archer

[57] ABSTRACT

A papermaking machine has a stock manifold or headbox which is tapered in the machine direction. Paper stock flows through a bank of tubes from the stock manifold to a slice for injecting stock onto a forming wire. Each tube in the tube bank extends in a plane which is substantially parallel to the direction of motion of the paper web being formed. The tubes are connected to the interior of the headbox manifold along a stock supply wall. A plurality of supply conduits are connected to the supply wall and discharge emollients such as chemicals and fillers into the manifold where they are immediately drawn, together with the stock, into adjacent tube ends which feed the stock and added chemicals to the slice for forming a paper web.

8 Claims, 6 Drawing Sheets

HEADBOX ADDITIVE INJECTION SYSTEM

FIELD OF THE INVENTION

The present invention relates to papermaking headboxes in general and in particular to headboxes employing constant volumetric flow tubes between the headbox manifold and the slice.

BACKGROUND OF THE INVENTION

In the formation of paper, wood fibers are dispersed in water to form a papermaking stock. The stock is usually at least 99 percent water and contains one-half to one percent paper fibers. The paper stock is injected through a tapered flow control channel known as a slice onto a fourdrinier moving wire screen to form the paper web. In some circumstances the stock is injected between two moving wire screens on a so-called twin wire machine. Water is drawn from the stock through the forming screens or wires leaving a web of paper fibers which is pressed and dried to form a web of paper.

Modern papermaking machines are between one and four hundred inches wide and operate at speeds up to and in excess of 4,000 feet per minute. Thus, the headbox and the slice which supply the paper stock which is formed into the paper web must supply not only a large quantity of stock to meet the high forming speeds of modern papermaking processes, but also supply the stock extremely uniformly if the sheet of paper formed is to be of uniform thickness across the width of the web.

To achieve the high flow rates and uniformity of stock injected through the slice, the stock is pumped at extremely high pressures by means of pumping equipment. An attenuator is disposed upstream relative to the headbox for damping pressure pulses caused by the stock pumping equipment. The arrangement is such that the rate of stock entering the headbox is relatively constant.

To achieve a uniform flow of stock onto the forming wire or wires, the headbox employs an inlet header or manifold which is of a tapered configuration. Between the inlet header and the slice are a plurality of distributor tubes which are arrayed in a tube bank. The tube bank is typically in the neighborhood of six tubes high by several hundred tubes long. The stock flows from the tapered tube inlets through each tube disposed within the tube bank. It is essential that the rate of flow of stock through each distributor tube be uniform in order that the stock exiting the lips of the slice be uniform from one edge of the forming wire to the other.

In order to achieve such constant flow rate, the inlet header or manifold is tapered in the cross-machine direction. In other words, the width of the manifold in the machine direction decreases further away from the stock inlet. The cross-sectional area of the inlet header at its narrowest is equal to the cross-sectional area of the inlet header at the stock inlet less three times the total area of the tubes opening off the header. As the flow of stock moves down the tapered header, a portion of the main flow is diverted through the tubes. Therefore, the cross-sectional area of the header is reduced as it moves in the cross-machine direction so that its area remains substantially equivalent to three times the cross-sectional area of the tubes not yet reached by the header. Thus, the cross-sectional area of the header is decreased in order to compensate for the loss of fluid volume as paper stock flows from one side of the header to the other. This change in cross-sectional area maintains the same pressure in the header in the cross-machine direction which in turn maintains the same flow through the tubes in the cross-machine direction.

Consequently, the rate of flow of stock through all of the tubes in the cross-machine direction is maintained substantially constant. However, in practice the consistency has not been sufficiently uniform to prevent some variation in paper weight or thickness in the cross-machine direction. Thus, in some paper forming headboxes actuators on the lip of the slice have been used to deform the slice lip to change the width of the slice opening in an effort to maintain a uniform paper weight across the paper web. In one recently developed system, described in U.S. Pat. No. 5,196,091 to Richard E. Hergert and incorporated herein by reference, the injection of diluting water into the headbox header or manifold adjacent to the tube inlets has been used to control the dilution of the stock in the cross-machine direction. This dilution control in turn acts to control the paper web weight or thickness. This technique in fact has resulted in the production of paper webs of more uniform characteristics.

The stock from which paper is formed contains not only paper fibers but various additives designed to improve or facilitate the production of the paper web. These additives include fillers such as clay which increase the opaqueness of the paper. Other additives include long chain polymers which aid in the retention of the filler within the paper web. Other materials combined with the stock include softening agents used with certain grades of tissue paper. Additionally, additives may be supplied which facilitate the bonding of fibers to one another, for example the starch. In the existing process for forming paper, these additives are added well before the headbox inlet header and are uniformly mixed with the stock.

Thus, while the addition of chemicals or fillers is often necessary for the formation of a particular paper web, current methods of dispersing the chemicals in the paper forming stock may be less effective than desirable because many of the additives are high molecular polymers which break down under the application of fluid shear. Thus these long chain polymers lose their effectiveness when subjected to the increasing shear which is often present in the stock as it proceeds to the head box distribution header. Other additives such as fillers would ideally not be uniformly distributed through the thickness or the z-direction of the paper web but rather be concentrated at the surfaces. This is not possible with current methods employing a single headbox and single slice.

Multi-ply webs are known to be formed employing headboxes wherein the header is divided into sections allowing stocks of different types to be simultaneously injected through a single slice to form a multi-ply web. However, these systems are designed to give webs with distinct fiber contents rather than a uniform fiber content with varying amounts of chemical additives or fillers. Further, such devices may have difficulties employing the stock dilution method discussed above in two or more headers simultaneously.

What is needed is an apparatus for varying the chemical and filler additives concentrations in the z-direction of a paper web.

SUMMARY OF THE INVENTION

The present invention is a headbox apparatus and method for injecting stock onto a forming wire for forming a web. The apparatus includes a housing which is connected to a pressurized source of stock. The housing defines a stock manifold or headbox which is tapered in the machine direction. A bank of tubes composed of a multiplicity of tubes allows stock to flow from the stock manifold to a slice for injecting stock onto a forming wire. Each tube in the tube bank extends in a plane which is substantially parallel to the direction of motion of the paper web being formed. Because each tube has a substantially constant flow of stock which progresses from the headbox manifold to the slice, the flow of stock from the slice onto the forming wire is substantially uniform in the cross-machine direction.

The tubes forming the tube bank are connected to the interior of the headbox manifold along a stock supply wall or surface. A plurality of supply conduits are connected to the plenum supply wall in a manner similar to the tubes for conducting stock to the slice. The supply conduits open between tube drain openings. The supply tubes supply chemicals and fillers to the manifold where they are immediately drawn, together with the stock, into adjacent tube ends which feed the stock and added chemicals to the slice for forming a paper web. The supply conduits are typically arrayed to supply a uniform stream of chemicals in the cross-machine direction. The tubes are also arranged to supply filler material or chemicals to the tube bank to preferentially supply chemicals to a particular location along the cross-machine axis, or to preferentially supply additives to a certain level within the forming web in the z-direction.

A typical tube bank consists of six tubes positioned one over the other with stock outlets that are deformed to form substantially rectangular openings with the tubes extending in the cross-machine direction numbering up to a few hundred. Thus, in the array formed of six tubes by a few hundred tubes, stock additives or chemicals will be added by supply conduits which extend along the entire cross-machine direction of the tube bank while being positioned adjacent to one of the six layers of tubes. If the stock additive is desired to affect the surface of the paper web being formed, the supply conduits will be adjacent to rows of tubes which will form the upper or lower layers of the paper whereas if the stock additives are to affect the interior properties of the paper web, they will be positioned near the middle of the six tubes forming the z-direction of the paper web.

It is a feature of the present invention to provide a headbox for forming a paper web which can provide controlled injection of stock modifying components in the z-direction.

It is another feature of the present invention to provide a headbox which controls base weight profile while at the same time supplying additives which are locally concentrated in a z-direction of the paper web and uniform in the cross-machine direction.

It is also a feature of the present invention to provide an apparatus and method for injecting stock additives to paper stock which does not subject the additives to excessive hydrodynamic shear before the stock is formed into a paper web.

It is an additional feature of the present invention to provide a headbox which facilitates the forming of a paper web with fiber bonding additives concentrated in the center of the through thickness of the web.

It is a further feature of the present invention to provide a headbox and method of forming which facilitates a paper web formed with fillers wherein the fillers are concentrated near the surfaces of the paper web.

Further objects, features and advantages of the invention will be apparent from the following detailed description when taken in conjunction with the accompanying drawings.

DESCRIPTION OF THE PREFERRED EMBODIMENT

Figure 1:
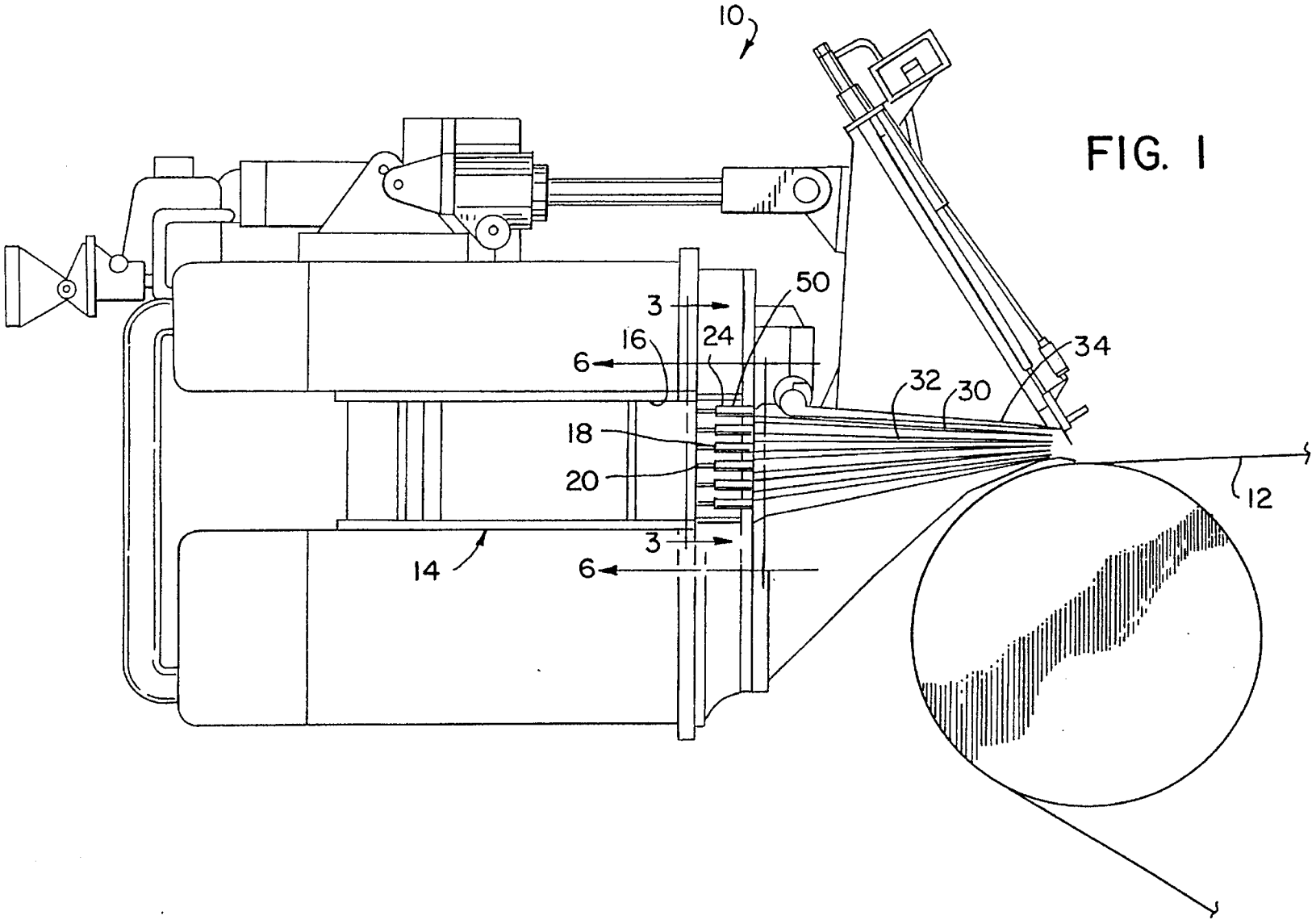
FIG. 1 is a cross-sectional view of the headbox apparatus of this invention.
Figure 2:
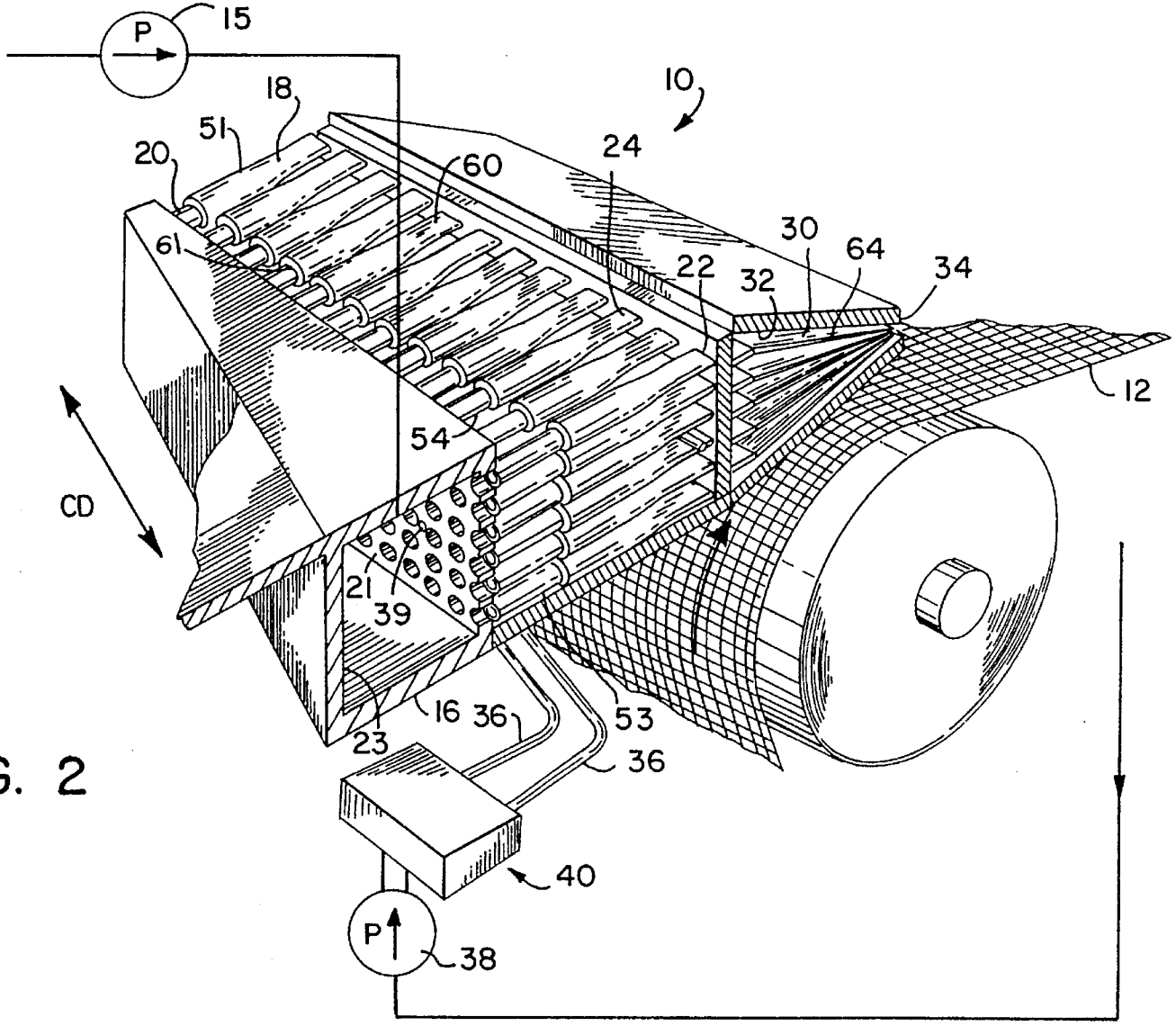
FIG. 2 is an enlarged isometric view, partly cut away, of the headbox apparatus of FIG. 1.

Referring more particularly to FIGS. 1–6, wherein like numbers refer to similar parts, a headbox apparatus 10 is shown in FIG. 1. As shown in FIG. 2, the headbox 10 has a housing 14 which is connected to a pressurized source 15 of stock. The housing 14 defines a tapered inlet of the stock supply manifold 16 through which stock is introduced to a tube bank 18. The tube bank 18 comprises an array of tubes 24 which are stacked alongside and one above the other. A means for introducing the emollients at selected levels within the formed paper web is provided by an arrangement of supply conduits described more fully below.

Each tube 24 extends from the supply manifold 16 to the slice chamber 30. The tube bank thus has an upstream end 20 at the manifold 16, and a downstream end 22 at the slice chamber 30. The upstream end 20 of the tube bank 18 joins the interior of the headbox manifold 16 at a stock supply wall or surface 21, shown in FIG. 2. Thus, the individual tubes 24 penetrate the stock supply wall 21 and, thus, communicate with the interior 23 of the headbox manifold 16 and are, thus, supplied with stock.

The tube bank 18 has an array of tubes 24. The array has a plurality of super-positioned rows 50 of tubes 24, generally five to seven rows, or the exemplary six rows shown in FIGS. 1, 2, and 3. Each row 50 has up to several hundred tubes 24 and extends substantially the entire length of the housing 14. The length of the housing 14 is approximately equal to the width of the paper web formed by the stock flowing through the headbox 10.

The downstream end 22 of the tube bank 18 is connected to the inlet or upstream end 32 of the slice chamber 30. The stock supplied to the slice chamber 30 passes through the slice chamber 30 and is ejected from the downstream end or lip 34 of the slice chamber 30 onto a forming wire 12, shown in FIG. 1. The rows 50 of the tube bank 18 define the width of the paper web formed on the wire 12 and each of the rows defines a portion of the through thickness or z-direction of the web. As shown in FIG. 2, trailing elements 64, long, thin hinged members disposed between rows 50 of the tube bank 18, keep the flow from the individual rows 50 separated from one another. The trailing elements 64 terminate adjacent to the lip 34 of the slice 30. The flow from each row 50 of tubes thus deposits fibers which form super-positioned, partially intermingled, strata in the z-direction of a paper web formed on the wire 12.

Figure 3:
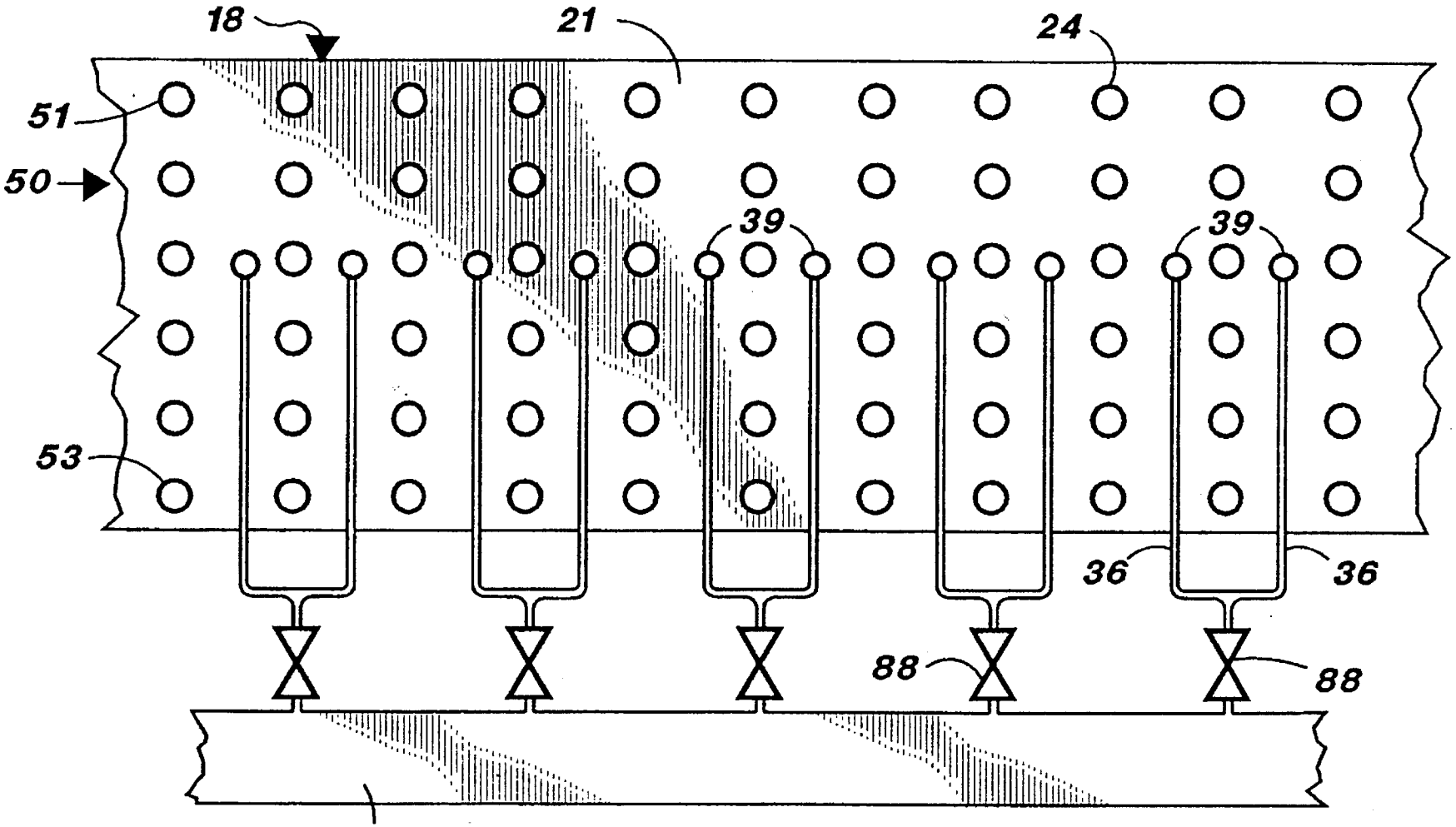
FIG. 3 is a cross-sectional view of the apparatus of FIG. 1 taken along section line 3—3.

As shown in FIG. 3, individual rows 50 of tubes 24 provide a nearly continuous sheet of stock to the slice 30. The rows 50 of tubes 24 are super-positioned with the uppermost row 51 corresponding to the uppermost layer of fibers in the paper web formed. The lowermost row 53 corresponds to the paper fibers at the bottom of the sheet in the z-direction which are formed against the moving wire 12.

Figure 5:
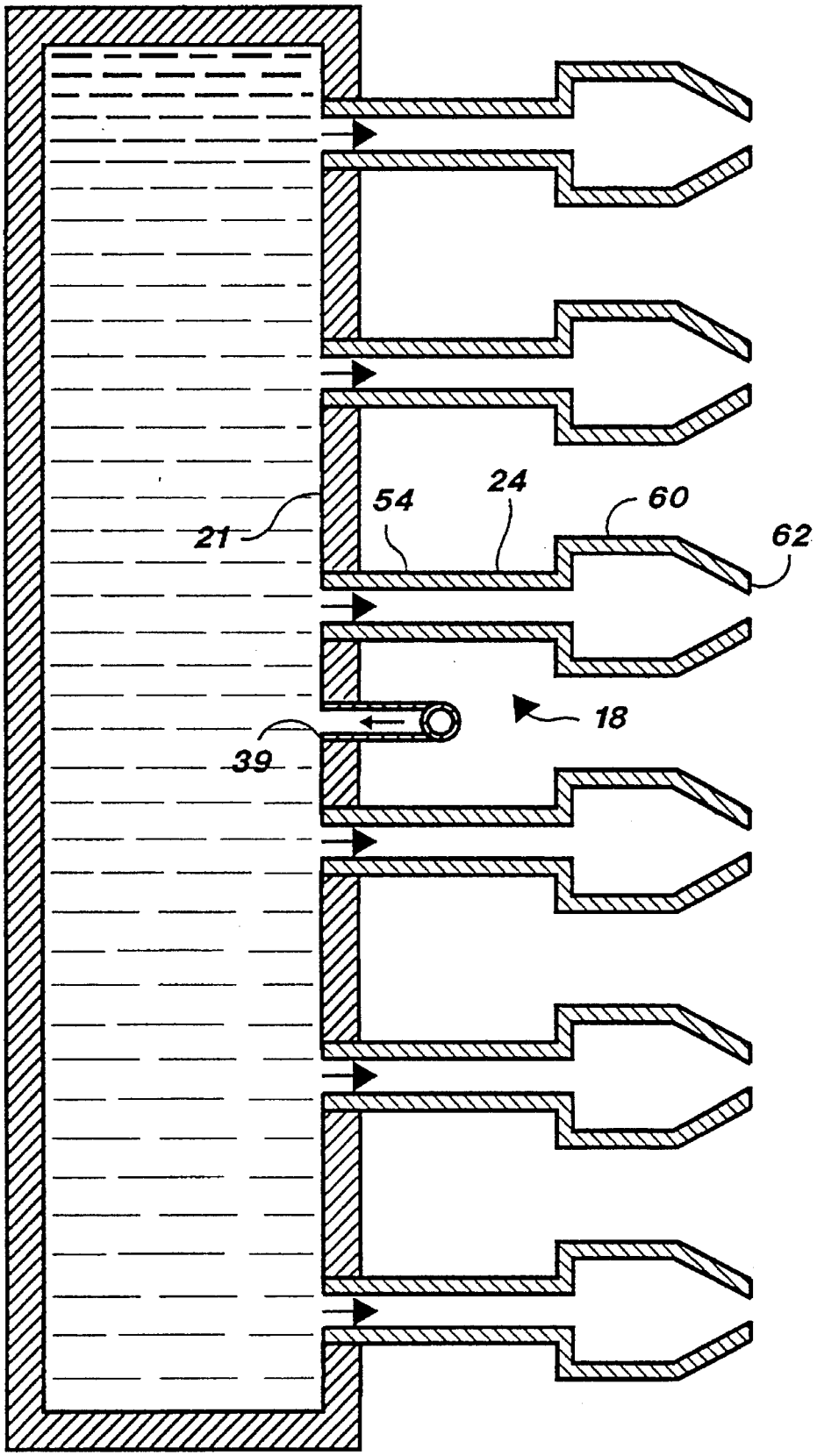
FIG. 5 is a diagrammatic representation of the tapered tubes taken along section line 5—5 of FIG. 6.
Figure 6:
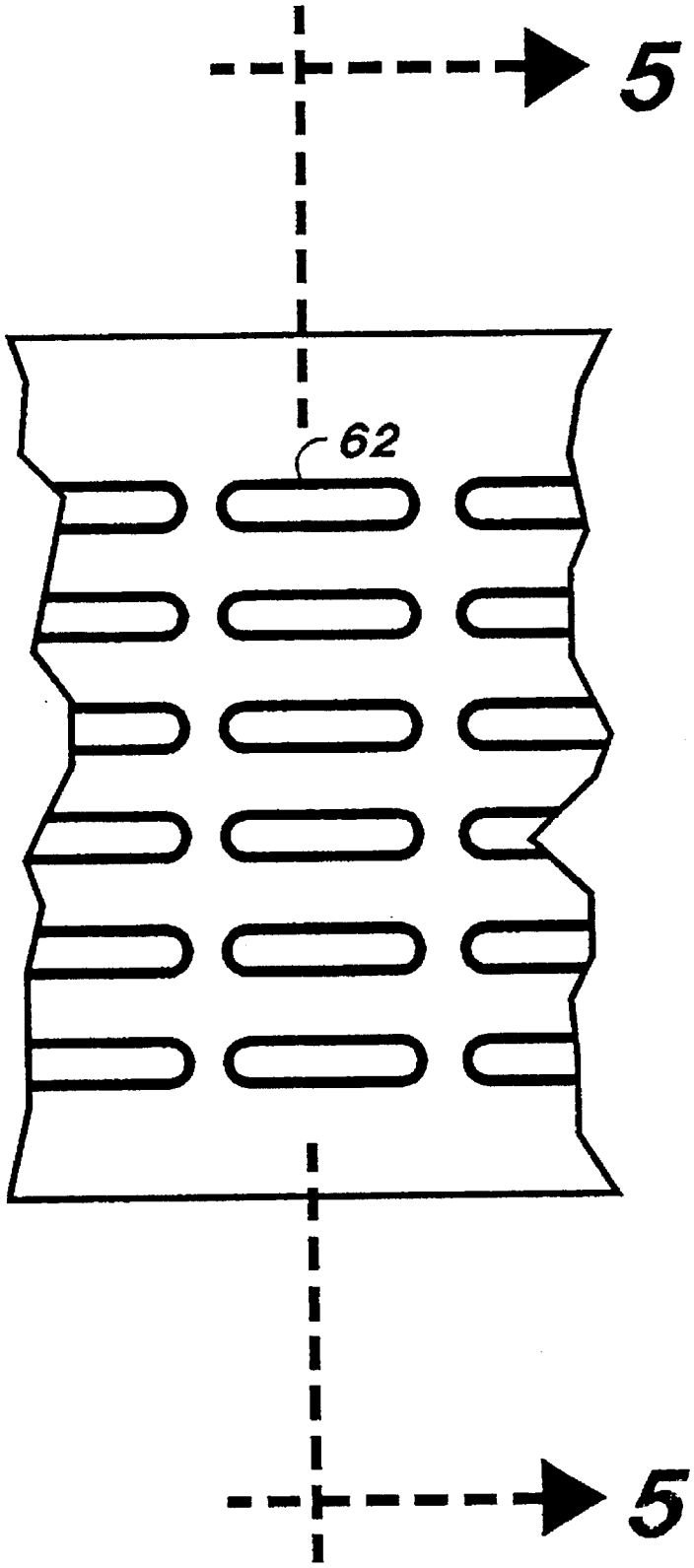
FIG. 6 is a cross-sectional view of the apparatus of FIG. 1 taken along section line 6—6.

As shown in FIG. 5, six rows of individual tubes 24 are vertically arrayed and extend from the supply wall 21. The tubes 24, thus, are positioned to receive stock from the stock manifold 16. Each tube 24 in a vertical array is from a different super-positioned row 50 of the tube bank 18. A plurality of supply conduits 36 discharge emollients into the manifold 16. A single supply conduit 36 injects emollients such as starch into the manifold 16 through the stock supply wall 21.

Although conduits may be positioned at different levels within the manifold, an exemplary supply conduit 36 is shown in FIG. 5 injecting stock between two rows 50 of tubes 24. As shown in FIG. 3, a plurality of supply conduits 36 connect a source of emollients 38 to a multiplicity of emollient injection points or openings 39 between individual tubes 24 in a row of tubes 50.

The illustrated emollient injection points 39 are positioned to add emollients to the center of the paper web. Emollients which may be added to the center of the paper web would include starch. When base weight paper or liner board is formed between a twin wire former, the center of the sheet can be subject to delamination. The center of the sheet can be strengthened by the selective addition of a binding agent such as starch to the central portion of the fiber web. If the injection points 39 are positioned adjacent to the uppermost row 51, or lowermost row 53, materials such as clay fillers could be selectively added near the surfaces of the paper where they improve the surface qualities.

The openings in the wire screen 12 used in a fourdrinier forming section are such that the majority of paper fibers can pass freely through them and thus the fourdrinier wire or the twin wires of a twin wire former rely on a mat of fibers of slightly larger size which builds up first on the wires to retain subsequent fibers from the stock. Certain long chain molecular additives can improve the initial retention of fibers on the wire thus facilitating a wire with a greater open area for more ready drainage of the paper web without excessive loss of fibers through the forming wires. These chemicals, while presently added generally to the stock, if selectively injected into the portion of the stock which first comes in contact with the forming wires, should perform their function of retaining initial fibers on the wire while at the same time reducing the quantity of chemical needed, as only that portion of the stock immediately adjacent to a forming wire need contain the polymer. This reduces costs by reducing chemical feeds as well as reducing the total concentration of chemicals in the waste water. Additionally, because long chain molecules can be broken down by fluid shear, subjecting the fluid to a relatively limited amount of shear between the headbox manifold 16 and the slice lip 34 means that less chemicals are needed to be effective.

The headbox 10 is designed to produce a uniform orientation and consistency of fibers laid down in the cross-machine direction on the wire 12. This uniformity starts with an attenuator (not shown) disposed upstream relative to the headbox for damping pressure pulses caused by the stock pumping equipment. The stock then flows into the manifold 16. The manifold is tapered in a cross-machine direction, either linearly or parabolically so that the pressure within the manifold remains constant in the cross-machine direction.

Figure 4:
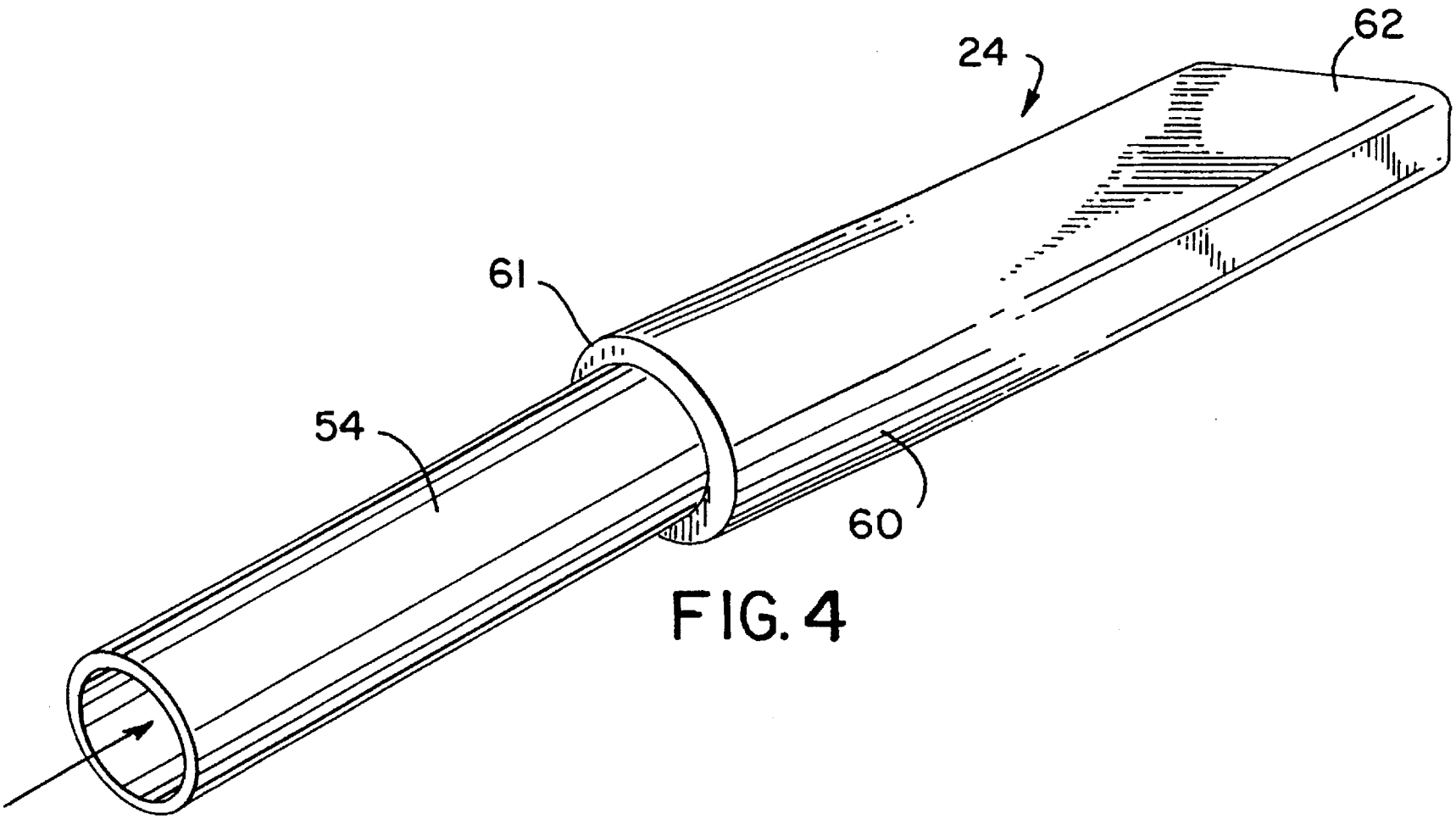
FIG. 4 is an enlarged isometric view of one of the tubes of the apparatus of FIG. 1.

The job of each tube 24, an example of which is best shown in FIG. 4, is to change the direction of the stock flow from the cross-machine direction to the machine direction. Each tube has an upstream section 54 which is generally cylindrical and which receives stock from the manifold 16. The upstream section 54 is joined at an expansion joint 61 to a flattened downstream section 60 which discharges stock onto the wire 12. The length of the upstream section 54 of the tube 24 is selected so the flow becomes completely symmetrical and aligned in the machine direction. The flow then undergoes a sudden expansion at the juncture 61 with the downstream section 60. The sudden expansion creates shear for improved fiber dispersion, and also creates head loss for cross-machine uniformity. Because flow through a pipe 24 is dependent on the entire pressure drop, a large pressure drop caused at the expansion joint 61 reduces the effect of upstream pressure variations so increasing uniformity of the flow through all of the tubes 24 in the tube bank 18.

The transition between the circular first section 54 and the circular second section 60 produces uniform and stable profiles within a short distance downstream of the expansion joint 61. The flow then smoothly transitions to a generally rectangular shaped outlet 62. The perimeter of the tube is kept constant, allowing the cross-sectional area to be decreased. The result is a tube section in which the flow accelerates, enhancing both flow stability and uniformity.

The critical parameter is the length of the downstream section 60 after the expansion joint 61. Proper length prevents a water rich, low consistency layer from building up near the tube walls.

Consistency measurements obtained by direct sampling of flow as it exits tubes of different lengths, shows that the longer the tube, the greater the consistency profile non-uniformity. The pressure drop in the tubes 24 combined with the uniform pressure profile within the manifold 16 means that the injection points 39 of the supply conduit 36 have minimal or no effect on the volumetric flows through the individual tubes 24. Further, because the injection points will preferably be evenly spaced in the cross-machine direction, any dilution effects caused by the emollient will be uniform in the cross-machine direction. Flow stability is enhanced in the slice chamber 30 by utilizing trailing elements 64 which have thicker base dimensions which limit the expansion of the flow as it enters the nozzle formed by the slice 30. For grades that are sensitive to paper orientation, it is desirable to align the flow path so that it is in line from the manifold 16 through the tube bank 18 and the slice 30.

As shown in FIG. 3, valves 88 may control the addition of emollients in the cross-machine direction from the emollient source 38. However, the valves will in general be adjusted to achieve a uniform injection of emollients in the cross-machine direction. Although the valves could be adjusted for downstream measurements of the effect produced by the emollients, they will in general remain relatively constantly actuated over time, and in many instances, valves 88 will not be required.

Although supply conduits have been shown within a single row or adjacent to two rows of tubes, two or more sets of supply conduits could be installed in a single headbox so that emollients of different types could be injected into different layers or regions in the through direction or z-direction of the paper web.

The injection of emollients could also be combined with a separate system for injecting white water to control the sheet consistency in the cross-machine direction. Such white water injection systems are described in U.S. Pat. No.

5,196,091 to Hergert, which is incorporated herein by reference. As shown in FIG. 2, a control means 40 may be installed between a source of emollient 38 and the supply conduits 36. One typical control means may be a metering pump which can supply a precisely controlled quantity at a controlled flow rate of emollient to the supply conduits 38 which inject through the injection points 39 into the manifold 16.

It should be understood that the high turbulent expansion joints 61 may facilitate the uniform mixing of the emollients with the stock flowing through the tubes 24. By utilizing the correct injection tube pattern and regulating the additive flow rates to the various injection tubes separately, the additive addition can be precisely controlled to preferentially concentrate the additives in any z-direction location in the sheet, bottom, center or top, or it can vary in the cross-machine direction to optimize the additive usage across the machine width.

Since the additives are injected directly into the headbox, the amount of fluid shear applied to the additives is minimized. This ensures minimum breakdown of high molecular weight polymers, and the maximum effectiveness of the chemicals used. Also, using several small injection tubes ensures better distribution of the emollients, and the localized mixing is improved as the region over which the additives diffuse is greatly reduced.

It should further be understood that the flow of the injection tubes can be supplied by a commonly controlled source to provide equal emollient addition at multiple injection locations. Alternatively, the additional flow rate to the various injection tubes can be regulated separately, providing the added flexibility to vary the additive addition rate in the cross-machine and z- or thickness direction for most effective emollient use. Further, it should be understood that this new method of injecting emollients which is controlled in both the z-direction and the cross-machine direction may advantageously be employed in the development of new chemical and chemical systems which cannot be utilized today because of the requirement of mixing the emollient or additive throughout the stock supply. Further, it should be understood that a parabolically tapered manifold, in one example where the manifold is nine meters long, would vary from the linear profile by approximately thirty millimeters at the point of maximum difference between the linear and the parabolic curve of the manifold.

It is understood that the invention is not limited to the particular construction and arrangement of parts herein illustrated and described, but embraces such modified forms thereof as come within the scope of the following claims.

I claim:

1. A headbox apparatus for ejecting stock onto a forming wire for forming a paper web of a given width and thickness, of the type having a housing connected to a pressurized source of the stock, said housing defining a tapered inlet for a flow therethrough of the stock;

a tube bank having an upstream end and a downstream end, said upstream end of said tube bank being connected to said tapered inlet such that the stock flows at a substantially constant flow rate through said inlet and through said upstream end of said tube bank to said downstream end of said tube bank;

said tube bank including a plurality of tubes for a flow therethrough of the stock, the plurality of tubes forming an array of tubes, the plurality of tubes extending substantially across the width of the paper, and defining an array width, the array of tubes having at least two rows of tubes which correlate to the thickness of the paper web and defining an array thickness;

a member defining a slice chamber, said slice chamber having an upstream end and a downstream end, said slice chamber upstream end being connected to said downstream end of said tube bank, said downstream end of said slice chamber being disposed adjacent to the forming wire such that the stock flows through said downstream end of said tube bank and through said upstream end of said slice chamber so that the stock is ejected from said downstream end of said slice chamber onto the forming wire, wherein the improvement comprises:

a plurality of supply conduits connected to said upstream end of said tube bank and spaced along the width of the tube array, each supply conduit of said plurality of supply conduits being connected to a source of an emollient for injecting emollients into the paper web being formed by said tube bank, wherein each supply conduit extends through said tube bank between adjacent tubes, each conduit discharging emollients within said stock inlet at a location closely adjacent to and upstream of a tube of said plurality of tubes.

2. The headbox apparatus of claim 1 wherein the supply conduits all terminate along a line corresponding to a selected location in the thickness of the paper web.

3. A method of adding emollients to papermaking stock, comprising the steps of:

injecting a supply of pressurized stock into a manifold of a headbox, the manifold being disposed upstream relative to a tube bank, wherein the manifold is tapered in the cross-machine direction;

simultaneously flowing the stock from the manifold through the tube bank comprised of at least two super-positioned rows of tubes, the super-positioned rows of tubes extending in the cross-machine direction and corresponding to the width of a web formed and the individual super-positioned rows corresponding to portions of the web formed in the z-direction; and simultaneously with the injection of stock into the at least two super-positioned rows of tubes, injecting along the width of the headbox an emollient, wherein the emollient is injected from injection points closely spaced to an upstream end of the tubes of the tube bank and wherein injection points are positioned to supply the emollient to a selected region of a through thickness of the paper web formed so that the emollient is not uniformly distributed in the z-direction of the paper web.

4. The method of claim 3, and wherein the emollient is starch and is injected at a location spaced from tubes of a center row so as to preferentially concentrate starch near the center of the paper web formed.

5. The method of claim 3 wherein the tube bank has at least three rows of tubes through which stock is simultaneously flowed, and wherein the emollient is introduced into the headbox to affect a surface quality of the paper web formed and is injected to be preferentially concentrated near the surfaces of the paper.

6. The method of claim 3 wherein the tube bank has at least three rows of tubes through which stock is simultaneously flowed, and wherein the emollient is designed to facilitate a retention of fibers on a forming wire and wherein the emollient is injected into the headbox to be concentrated in a portion of the paper web adjacent to a forming wire.

7. The method of claim 3 wherein the manifold has a stock supply wall which forms an upstream side of the tube bank and wherein the emollient is injected through the stock supply wall into the manifold and adjacent to selected tube openings that correspond to a selected region of the z-direction of the paper web formed.

8. A headbox apparatus for ejecting stock onto a forming wire for forming a paper web of a given width and thickness, the apparatus comprising:

a pressurized source of papermaking stock;

a housing connected to the pressurized source of the stock, said housing defining a tapered inlet manifold for a flow therethrough of the stock;

a tube bank having a plurality of rows of tubes, wherein each row of said plurality of rows of tubes has a plurality of aligned tubes, and wherein each tube receives stock from the inlet manifold, such that the stock flows at a substantially constant flow rate through said manifold;

a slice chamber extending between said tube bank and a forming wire, wherein fluid discharged from the tubes is flows through the slice chamber to be discharged onto a forming wire, to form a paper web thereby;

a source of emollients; and a means for introducing the emollients at selected levels in a z-direction within the formed paper web, wherein the introducing means is connected to the emollient source, and the introducing means discharges through a plurality of outlets into the inlet manifold.

* * * * *

UNITED STATES PATENT AND TRADEMARK OFFICE

CERTIFICATE OF CORRECTION

PATENT NO. : 5,560,807

DATED : 10/01/96

INVENTOR(S) : Merle Hauser

It is certified that error appears in the above-indentified patent and that said Letters Patent is hereby corrected as shown below:

Column 4, line 41: --that is tubes 24 which are stacked alongside and one above the other, that is,-- was omitted after "tubes 24".

Signed and Sealed this

Fifteenth Day of April, 1997

Bruce Lehman

*Attest:*

BRUCE LEHMAN

*Attesting Officer*

*Commissioner of Patents and Trademarks*